United States Patent [19]

Zollner et al.

[11] 4,403,118

[45] * Sep. 6, 1983

[54] METHOD FOR GENERATING ACOUSTICAL SPEECH SIGNALS WHICH CAN BE UNDERSTOOD BY PERSONS EXTREMELY HARD OF HEARING AND A DEVICE FOR THE IMPLEMENTATION OF SAID METHOD

[75] Inventors: Manfred Zollner; Christian Hoffmann, both of Munich; Eberhard Zwicker, Icking, all of Fed. Rep. of Germany

[73] Assignee: Siemens Aktiengesellschaft, Berlin & Munich

[ * ] Notice: The portion of the term of this patent subsequent to Sep. 15, 1998, has been disclaimed.

[21] Appl. No.: 245,914

[22] Filed: Mar. 20, 1981

[30] Foreign Application Priority Data

Apr. 25, 1980 [DE] Fed. Rep. of Germany ..... 3016128

[51] Int. Cl.³ ..... H04R 25/00

[52] U.S. Cl. ..... 179/107 FD

[58] Field of Search ..... 174/107

[56] References Cited

U.S. PATENT DOCUMENTS

| | | | |
|---|---|---|---|
| 3,385,937 | 5/1968 | Lafon | 179/107 |
| 3,600,524 | 8/1971 | Biondi et al. | 179/107 FD |
| 3,819,875 | 6/1974 | Velmans | 179/107 FD |

FOREIGN PATENT DOCUMENTS

| | | | |
|---|---|---|---|
| 2613513 | 10/1977 | Fed. Rep. of Germany | 179/107 |

OTHER PUBLICATIONS

"Speech Analysis . . . ," Flanagan, 1972, Springer-Verlag, pp. 323-326.

"Experiments in Hearing," Von Bekesky, 1960, McGraw-Hill, pp. 546-634.

IEEE Transactions on Acoustics . . . , vol. ASSP-24, No. 6, pp. 473-480.

*Primary Examiner*—G. Z. Rubinson

*Assistant Examiner*—L. Schroeder

*Attorney, Agent, or Firm*—Hill, Van Santen, Steadman & Simpson

[57] ABSTRACT

In the illustrated embodiments, the signals to be transmitted are converted into electrical signals and are divided by means of filters into a plurality of frequency bands. The envelopes of the signals coming out of the filters are then employed for the modulation of tones. Finally, the original tones and the modulated tones are supplied to the hearing-impaired person as an audio signal. To this end, the disclosure provides that the original signal to be transmitted is transmitted together with the modulated tones, and that the ratio of the volumes of the original tones and those of the modulated tones is set to a ratio which is comfortable for the hearing-impaired person. The transmission of the modulated tones is at least partially interrupted for voiced sounds. Standard ear sets or implanted devices with direct electrical transmission of the signals to the auditory nerve can be employed for transmission to the hearing-impaired person. Disclosed methods and devices are particularly employable as a hearing aid for persons who are extremely hard of hearing or who have suffered total hearing loss.

32 Claims, 3 Drawing Figures

METHOD FOR GENERATING ACOUSTICAL SPEECH SIGNALS WHICH CAN BE UNDERSTOOD BY PERSONS EXTREMELY HARD OF HEARING AND A DEVICE FOR THE IMPLEMENTATION OF SAID METHOD

CROSS REFERENCE TO RELATED APPLICATION

The present application incorporates the subject matter of our copending application Ser. No. 125,046 filed Feb. 27, 1980 (now U.S. Pat. No. 4,289,935 issued Sept. 15, 1981), and priority based on said copending application, for the common subject matter, is claimed under 35 U.S.C. § 119 and § 120.

BACKGROUND OF THE INVENTION

The invention relates to a device for supplying persons extremely hard of hearing with acoustical signals according to the introductory (generic) part of claim 1 and to devices for implementing said method. Such methods and devices are the subject matter of the German Pat. No. 29 08 999.

Known from the U.S. Pat. No. 3,385,937 is a hearing aid with a microphone for the conversion of the received acoustical signals into electrical signals of which those which are allowed to pass by filters are employed for the modulation of an electrical auxiliary alternating current, the modulated signal being then supplied, after amplification and conversion in a headset, as an acoustical signal to the ear. In this system the filters are to be designed in such manner that they only allow signals to pass whose frequencies either lie between 1500 and approximately 3500 Hz or between a first value of the range 4500 through 6000 Hz and a second value of the range 7000 through 8000 Hz and that the frequency of the electrical compensation voltage lies between 350 and 1000 Hz. That part of the signals arriving from the microphone which lies below approximately 1000 Hz can be added to such a compensation voltage or, respectively, a pair of such voltages. Such hearing aids, however, have not been able to prevail in hearing aid technology because, given only one filter, the filter width 1500 Hz through 3500 Hz is too broad and, given employment of two filters, the filter widths are too narrow and important speech information is not made available to the person who is hard of hearing.

SUMMARY OF THE INVENTION

The object of the invention, given a method for supplying persons who are extremely hard of hearing with acoustical signal according to the introductory part of claim 1, is to select the signals to be transmitted in such manner that, in addition to good comprehension, a simplification of the apparatus format likewise becomes possible. This object is inventively achieved by means of the features cited in the characterizing part of said claim.

In the above German patent, the invention proceeds from the fact that language can be greatly reduced in terms of its informational content without significantly losing in terms of comprehension and that fluent speech can still be well understood given a syllable comprehension of 50%. It therefore converts a part of the speech information to be transmitted into amplitude-modulated sinusoidal or rectangular tones and adds these amplitude-modulated tones to the original tone. If, for example, the higher frequency speech range lying approximately between one kilohertz and eight kilohertz, or betwen two kilohertz and eight kilohertz is transmitted in the form of a plurality of modulated tones at the upper residual hearing range of 500 Hz through 1 kHz or, respectively, 1 kHz through 2 kHz, then, after a learning phase, the identifiability of fricatives and stops such as s, ʃ, x, t, is increased to more than 90% certainty. Without said conversion, however, said sounds could only be guessed at.

In comparison to a method according to the U.S. Pat. No. 3,385,937, an improvement of comprehension is obtained because the information necessary for a person who is hard of hearing for speech comprehension is transmitted in the necessary plurality of amplitude-modulated tones. Moreover, the advantage is achieved that, due to transmission of the entire speech signal, the hard of hearing person can exploit all speech information which is available to him in a direct manner.

According to the present invention, beyond that, the advantages is achieved by means of the at least partial cutoff of the modulated tones for voiced sounds that, given voiced sounds, the original signal is covered as little as possible by the Vocoder for hearing-impeded persons with a pronounced loss of treble tones. Given voiceless (high frequency) sounds, which are no longer heard by the hearing-impeded person, the Vocoder, however, is switched on and effects a transposition. A parital cut-off (of some of the channels) of the Vocoder can also be advantageous: Thus, for example, the highest Vocoder channels need no longer be connected; only slight voltages are produced in them given voiced sounds. As a rule, the cut-off of the plurality of channels will be matched to such effect that one therewith optimizes maximum syllable comprehension for the hearing-impeded person.

A channel Vocoder as is employed in devices for speech synthesis (cf., for example, Flanagan, J. L., "Speech Analysis Syntheses and Perception", Springer-Verlag, Berlin, Heidelberg, New York, Second edition (1972), pages 321 through 326) can be employed as a device for the conversion of normal, acoustical tones into, for example, sinusoidal tones. Given such a Vocoder, speech given voiced sounds is simulated by means of a spectrum consisting of equidistant lines. Thereby, neighboring lines are collected into frequency bundles and are modulated in their amplitude. For voiceless sounds, a change is undertaken from the line spectrum to a noise spectrum. Proceeding therefrom, such a Vocoder can be simplified in that, on the one hand, voiceless sounds are also simulated by means of a line spectrum in that, for instance, the change-over to a noise spectrum is eliminated. On the other hand, an attempt can be made to reduce the number of lines of the spectrum. A first limiting value for this is reached when only one line, for example that line which lies at the center frequency of the respective channel, remains in each frequency band. This is based on the fact that, for example given a basic speech frequency of 100 Hz, six lines can lie in the frequency band between 2050 Hz and 2650 Hz which, however, are combined into a single line at 2350 Hz. A second limiting value occurs when the number of frequency bands is reduced to so few bands that the speech can no longer be understood because significant components of the speech information are no longer transmitted.

Upon employment of methods standard in audiometry, for example of the "Freiburg Speech Comprehension Test", a corresponding examination can ensue. Thereby, the individual words can be separated from one another by a pause of approximately 2 seconds and can be offered without repetition. A test can comprise 150 words, of which none is repeated. Thereby, after an orientation phase lasting approximately 15 words, 30 words are offered per partial test in the actual test.

Although fricatives and stops—reproduced by means of individual, amplitude-modulated sinusoidal tones—sound unnatural, they are perceived without difficulty after a short acclimatization phase. This result makes it clear that sufficient information concerning the speech content is already contained in the power spectrum of spoken language.

A phase-locked coupling of the individual partial tones seems to be just as unnecessary as the reproduction of specific harmonics of the original spectrum. In order to investigate the effects of a shift between analysis frequency $f_m$ and synthesis frequency $f_G$, all generator frequencies $f_G$ were reduced to their 0.7 multiple in two experiments. Thereby, comprehension sank from 94% to 92% given a six line spectrum and from 60% to 55% given a three line spectrum.

In addition to monosyllabic comprehension, the comprehension of fluent speech was also judged. Thereby, it was shown that fluent speech can be well understood when the monosyllabic comprehension lies at or above 50%, i.e. given a spectrum with at least three lines. If, instead of the lower spectral line, the low-pass-filtered component of the original language ($f_G$=250 Hz) is transmitted, the naturalness of fluent speech can be significantly increased.

In particular, a discrimination between a male and female speaker is also possible, even though the monosyllabic comprehension is practically not improved.

Given persons who are hearing-impaired with a pronounced loss of treble hearing, an attempt can be made to transform the speech frequency range to the residual hearing range with the assistance of a Vocoder with, for example, eleven channels. To that end, it would lie close at hand to first detune all generator frequencies $f_G$ in such manner that they are theoretically uniformly distributed over the residual hearing frequency range, i.e., for example, generate an equidistant spectrum in the range 100 Hz through 1 kHz given an upper hearing limit of 1100 Hz. The "transformed speech " generated in such manner, however, is characterized by the patient as being incomprehensible. In a test which led to the invention, thus, the original speech was also transmitted unfiltered. For the compensation of the said loss of treble hearing, the Vocoder-transformed component contains the higher-frequency speech range (1 kHz through 8 kHz or, respectively, 2 kHz through 8 kHz) which was converted to the upper residual hearing range (500 Hz through 1 kHz, or, respectively, 1 kHz through 2 kHz). Even given this manner of offering, the speech intelligibility was first hardly increased, i.e. at the beginning of the tests; after a learning phase of approximately one hour, however, the sounds s, ʃ, x, t could already be perceived with more than 90% certainty. Without a Vocoder, these sounds could only be guessed at.

The volume ratio between the original speech and the Vocoder spectrum is to be individually determined for each patient, because the hearing residues differ greatly from patient to patient and both residual hearing frequency range as well as the function of sensitivity to volume exhibit great individual fluctuations. Two limiter amplifiers which are looped into the two signal paths, i.e. the path of the original signal and in that of the Vocoder signal, prove extremely helpful for the adjustment because, given an information transmission which is still sufficient, the mutual masking of the two signals can be kept small by so doing. The overall volume could also be set to a level that was pleasant for the patient with said limiter amplifiers.

In addition to sinuoidal tones, other tones, such as rectangular or triangular tones, can also be employed. Rectangular generators, for example, can be advantageously employed, particularly given a high degree of treble loss and, similar to triangular generators, can be more easily manufactured than sinusoidal generators.

Further details and advantages of the invention are explained below in greater detail on the basis of the exemplary embodiments illustrated in the figures on the accompanying drawing sheet; and other objects, features and advantages will be apparent from this detailed disclosure and from the appended claims.

DETAILED DESCRIPTION

Figure 1:
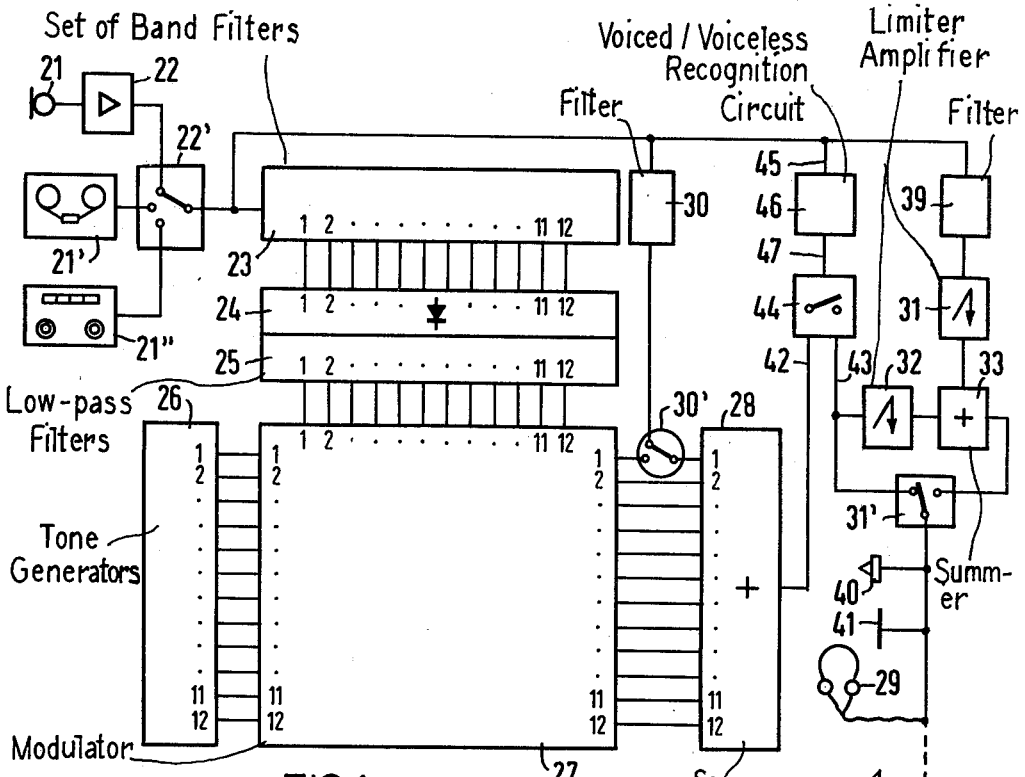
FIG. 1, in a schematic block diagram, shows an inventive device.

The audio signals picked up in a microphone 21 and coverted into electrical signals are supplied via a preamplifier 22 to a set of band filters 23. Said set of filters 23 is the input part of a Vocoder which comprises the components 23 through 28. The input audio signals can also derive from a tape recorder 21' or from some other sound transducer 21'', for instance a radio receiver. By means of an appropriate setting of the switch 22', each input source is selectively connectable to the set of band filters. The latter contains twelve band filter with outputs numbered 1 through 12. The individual filters have mean frequencies of 225 Hz, 365 Hz, 515 Hz, 690 Hz, 915 Hz, 1.2 kHz, 1.6 kHz, 2.2 kHz, 2.9 kHz, 4.1 kHz, 5.8 kHz and 8.3 kHz. The band width of the individual filters respectively corresponds to approximately $\Delta f$=30% $f_m$ ($f_m$=mean frequency) or 1.5 bark. The channel separation of adjacent filters, measured at the mean frequency, amounts to 11 dB through 17 dB. The voltages at the outputs numbered 1 through 12 are supplied to corresponding half-wave rectifiers of component 24 and, for the purpose of smoothing, subsequently respectively traverse a low-pass filter of the second order of component 25. The response time of the respective low-pass filters of component 25 is longer for the channels of the lowest mean frequencies than for those of the remaining mean frequencies and amounts, for example, to forty milliseconds (40 ms) for the lower six channels and to eight milliseconds (8 ms) for the remaining channels. The envelopes of the individual channels number 1 through 12 gained in that manner then modulate the tones coming from a set of generators of component 26 with the frequencies $f_G$(G=1 through 12) in a modulator 27. The frequencies $f_G$ to be modulated, given persons with normal hearing, will thereby respectively correspond to the mean frequency $f_m$ of the appertaining band filter. The outputs of the modulator 27 lead to a summer 28 and are united there to form a uniform frequency mix. Given a switch 44 which is closed to establish an electrical connection of lines 42 and 43, the outputs of modulator 27 can then be directly supplied via a switch 31' to a headset 29. This can be a set for air-borne sound or can be a set for a bone-borne sound.

Instead of the lowest, modulated sinusoidal tone in the channel number 1, a component of the original speech obtained via a low-pass filter 30 can optionally be added to the synthetic speech. The connection of the filter 30 ensues via a switch 30'. Thereby, it becomes possible to also transmit the original pitch.

The synthetic speech generated by the Vocoder 23 through 28 is offered to the hearing-impaired person at both ears via the headset 29.

Given persons with damaged hearing, for example with a pronounced loss of treble tones, a compensation can be achieved by the means of transformation of the spech frequency range into the residual hearing range. To that end, the frequencies $f_G$ of the set of generators 26 are set in such manner that the speech comprehension becomes optimum i.e., for example, given a loss of treble tones, higher-frequency components from 1 kHz through 8 kHz or, respectively, 2 kHz through 8 kHz are transmitted on the residual hearing range from 500 Hz through 1 kHz or, respectively, 1 kHz through 2 kHz. This produces a signal which, after a learning phase of approximately one hour, allows hearing-impaired persons to perceive speech information with high frequency components, for example the sounds s, ∫, x, with over 90% certainty. Without the Vocoder 23 through 28, the said sounds can only be guessed at.

The volume ratio between the original speech from the microphone 21 and the microphone amplifier 22 and the Vocoder spectrum from 23 through 28 must be individually identified and set for each patient. Thereby, it has proven extremely helpful to employ two limiter amplifiers 31 and 32 which are looped into the respective signal paths. The signals from said two amplifiers 31 and 32 are then brought together in a summer 33 and are supplied to the headset 29 via a switch 31' when said switch 31' is moved from the position illustrated in FIG. 1 to the other contact (shown free in FIG. 1).

The inventive arrangement also allows implanted hearing aids to be employed. Given said implanted hearing aids, the editing of the signals generally ensues in a primary device. The signals to be transmitted to the person with impaired hearing, (e.g. to the auditory nerve) are then supplied to the implanted part of the device, either wirelessly, for instance inductively or by means of ultrasonics, or via a wire-bound system. Such devices are described, for example, in the periodical HNO 26 (1978), pages 77 through 84.

In a device according to FIG. 1, the transmission into a hearing aid 37 implanted in the body 35 can ensue wirelessly in that a transmitter, for example, a repeating coil 34 is connected instead of the headset 29, a corresponding receiver, for example a receiver coil 36 which can be implanted, for example, behind the ear being allocated to said repeating coil 34. A corresponding device 37 is likewise implanted to which an arrangement of electrodes referenced with 38 which are allocated to the ends of the auditory nerves is connected. In the present context, thereby, the advantage is offered that the number of electrodes can be kept small because, due to the speech conversion in the circuit described, the information flow is reduced to a size necessary for comprehension.

This advantage can also be brought to bear, particularly, when speech information is to be transmitted to other senses given persons with extremely impaired hearing or total loss of hearing. To that end, for example, vibrotactile or electrocutaneous stimulation is employed in a known manner (cf., for example, the book "Experiments in Hearing" by Georg von Bekesy (1960), McGraw-Hill Book Co., Inc., New York, Toronto, London (1960), pages 563 and 596; the periodical "New Scientist" (Jan. 26, 1978), page 219 "Hearing By The Skin of Your Body"). Thereby, in contrast to hearing, only a lesser information flow can be transmitted because the sensitivity of the skin's senses which are influenced by the stimulation is less than that of hearing. As transmitters for the application of the said stimulations, so-called vibrators 40 or, respectively, electrodes 41 as electrocutaneous stimulators can be employed as are indicated in FIG. 1 as a replacement for the headset 29.

The switch 44 which can disconnect the connection between the lines 42 and 43 is provided in order to make the disconnection of the Vocoder possible. The position of the switch 44 is determined by the signal of the control line 47.

Figure 2:
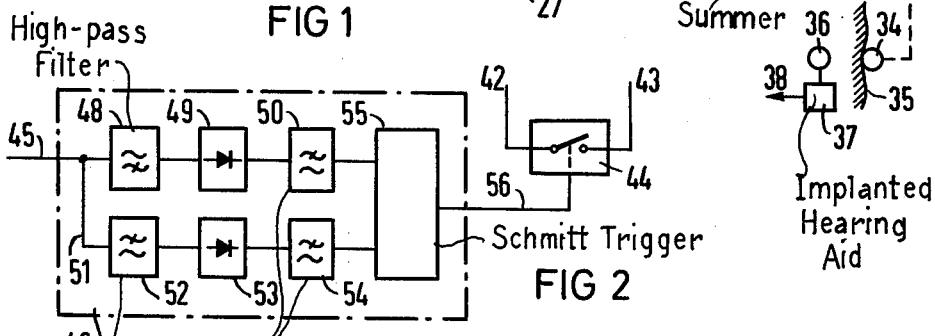
FIG. 2 is a circuit diagram showing an exemplary voiced speech recognition circuit in greater detail.

The control means 46 as shown in FIG. 2 includes a series connection of a high-pass filter 48, a rectifier 49 and a low-pass filter 50 on the one hand as well as in a branching 51 from the line 45, a low-pass filter 52, a rectifier 53 and a further low-pass pass filter 54. The two series connections 48 through 50 and 52 through 54 have their outputs coupled to a Schmitt trigger 55 which can effect the actuation of the switch 44, as is indicated via a connection 56. The combination consisting of the two series connections 48 through 50, 51 through 54 and of the Schmitt trigger 55 represents a recognition circuit for voiced or, respectively, voiceless sounds with which a control signal can be derived from a comparison of the spectral components which have a high and low effect. Thereby, the high-pass filter 48 represents a high-pass filter of the second order with $f_g=5$ kHz. Component 52 is a low-pass filter of the second order with $f_g=400$ Hz and the two low-pass filters 50 and 54 are likewise filters of the second order and have $f_g=60$ Hz.

The effect of the voiced/voiceless recognition circuit can be explained in such manner that, given voiceless sounds, the higher-frequency spectral components predominate so that a higher voltage derives at the output of the low-pass filter 50 than derives at the output of the low-pass filter 54. Thus, the Schmitt trigger 55 flips and the switch 44 is switched on via the control line 56. Given voiced sounds, the Schmitt trigger 55 flips into the other position and the switch 44 is switched off.

Figure 3:
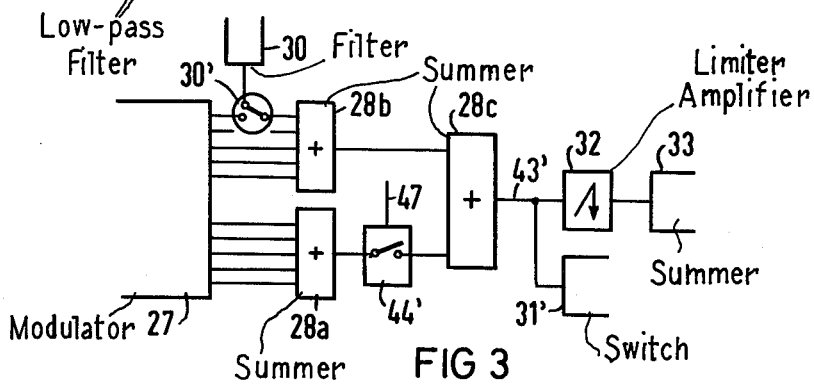
FIG. 3 shows a further development where certain of the modulators are disconnected for voiced sounds.

A disconnection of only a few channels (outputs number 1 through 12) of the band filters 23 can be achieved in accord with FIG. 3. To that end, parts can be separated (disconnected) from the summer 28; for example a part **28*a* can be disconnected, for example by a switch 44' which is electronically controlled by line 47 which is controlled by recognition circuit 46**.

The combination of the partial signals proceeding from summers **28*a* and 28*b* ensues in a further summer 28*c*. The connection of summer 28*c* with limiter amplifier 32 is provided by a line 43' which corresponds with the line 43 of FIG. 1. The line 42 of FIG. 1 is omitted in the arrangement according to FIG. 3 because the circuit of FIG. 3 is already provided with a switch 44' before the final summer 28*c*** coinciding with component 28 of FIG. 1, for automatically disconnecting the output of summer 28*a* when voiced sounds predominate.

It will be apparent that many modifications and variations may be effected without departing from the scope of the novel concepts and teachings of the present invention.

SUPPLEMENTARY DISCUSSION

German Pat. No. 29 08 999 with a filing date of Mar. 8, 1979, corresponds to Zollner, Hoffmann and Zwicker U.S. application for patent Ser. No. 125,046 filed Feb. 27, 1980 (now U.S. Pat. No. 4,289,935 issued Sept. 15, 1981), and said U.S. application claims priority based on the German application No. P29 08 999.4 which has matured into the above-mentioned German patent. The disclosure of said U.S. application Ser. No. 125,046 is incorporated herein by reference as providing background with respect to the present invention.

In an exemplary embodiment of the circuit of FIG. 2, high-pass filter 48 may be of the first through tenth order, for example of the second order, with a frequency $f_g$ between one kilohertz and ten kilohertz, for example five kilohertz, while low-pass filter 52 may of the first through tenth order, for example of the second order, with a frequency $f_g$ between fifty hertz and two thousand hertz, for example four hundred hertz. The low pass filters 50 and 54 may be of the first through tenth order, for example the second order, with a frequency $f_g$ between ten and two hundred hertz, for example sixty hertz.

The frequency $f_g$ in each case refers to the mean frequency of the respective filter 48, 50, 52 and 54 in FIG. 2.

The disclosure of said application U.S. Ser. No. 125,046 (now U.S. Pat. No. 4,289,935) is also incorporated herein by reference as disclosing the apparatus invention to be claimed herein. In this respect priority is claimed under 35 U.S.C. 119 and 120, based on German application No. P29 08 999.4 filed Mar. 8, 1979.

We claim as our invention:

1. A method for generating acoustical speech signals which are comprehensible to persons who are extremely hard of hearing, in which acoustical signals to be transmitted have been converted into electrical signals representing original tones, said method comprising dividing the electrical signals into a plurality of frequency bands by means of filters, forming envelope signals from the outputs of the filters, modulating respective tone signals in accordance with the envelope signals to provide modulated tone signals, supplying the modulated tone signals together with the electrical signals representing original tones for transmission to a hearing-impaired individual, and setting the ratio of the volume of the modulated tone signals to that of the original tones, and the overall volume, to a level which is confortable for the hearing-impaired person, characterized in at least partially interrupting the supply of the modulated tones to the hearing-impaired person for voiced sounds.

2. A method according to claim 1, characterized in that the modulated tones are automatically entirely interrupted when voiced sounds predominate over voiceless sounds.

3. A method according to claim 1, further comprising at least partially disconnecting a multi-channel Vocoder which generates the modulated tone signals by means of a switch responsive to the predominance of voiced sounds over voiceless sounds.

4. A system for implementing a method according to claim 1, said system comprising a transducer for supplying electrical signals representing original tone signals, a set of band filters connected to the transducer, having respective mean frequencies ($f_m$), and having respective outputs, half-wave rectifiers connected to the outputs of the filters, and smoothing low-pass filters of the second order whose response time lies between forty milliseconds and eight milliseconds coupled in circuit with the rectifiers, audio generators having frequencies ($f_G$) for modulation by the outputs of the smoothing low-pass filters and having generator outputs for supplying modulated tone signals, a summer having inpus coupled with the generator outputs, and a signal transmitter which can be brought into operative coupling with the hearing-impaired person, characterized by a voiced/-voiceless recognition circuit for supplying a switching signal in accordance with the predominace of voiced over voiceless speech in said original tone signals, and means controlling the operation of the summer in accordance with said switching signal for at least partially interrupting the transmission of the modulated tone signals to the hearing-impaired person when voiced speech predominates over voiceless speech.

5. A system according to claim 4, characterized in that the recognition circuit comprises first and second series circuits, the first series circuit comprising a high-pass filter, a rectifier and a first low-pass filter, and said second series circuit comprising a second low-pass filter, a rectifier and a third low-pass filter.

6. A system according to claim 5, characterized by said first series circuit comprising a high-pass filter of the first through tenth order, $f_g=1 \ldots 10$ kHz, said second series circuit comprising a second low-pass filter of the first through tenth order, $f_g=50 \ldots 2000$ Hz, and said first and second series circuits having first and third low-pass filters of the first through tenth order, $f_g=10 \ldots 200$ Hz following the respective rectifiers.

7. A system according to claim 6, characterized in that the high-pass filter is a high-pass filter of the second order with $f_g=5$ kHz, the second low-pass filter being a low-pass filter of a second order with $f_g=400$ Hz and the first and third low-pass filters being low-pass filters of a second order with $f_g=60$ Hz.

8. A system for implementing the method according to claim 1, characterized in that a Schmitt trigger is employed as the actual switching element for controlling the at least partial interruption of the modulated tone signals.

9. Apparatus for generating acoustical voice signals which are intelligible to persons extremely hard of hearing, but having a sensory response to frequencies in a given sensory spectrum, comprising:

(a) input means for supplying an input signal in accordance with an acoustical voice signal to be made intelligible to an individual with a given sensory spectrum, (b) filter means for dividing the input signal into a plurality of frequency bands to provide output signals of different frequency bands, (c) modulating means for modulating alternating waveform signals of different frequencies within the given sensory spectrum with the envelopes of the output signals of said different frequency bands, to provide modulated tone signals, and (d) combining means for combining the modulated tone signals with frequency components of the input signal, and supplying the resultant signal to the individual having said given sensory spectrum, wherein the improvement comprises (e) said filter means dividing the input signal in accordance with the acoustical voice signal, into at least three frequency bands to thereby provide output signals in a multiplicity of different frequency bands with respective mean frequencies ($f_m$), (f) said modulating means modulating a multiplicity of alternating current waveforms of different frequencies ($f_G$) within the given sensory spectrum with the envelopes of respective ones of said output signals in said multiplicity of different frequency bands, to provide a multiplicity of modulated tone signals, (g) said combining means combining the multiplicity of modulated tone signals with the total spectrum of said input signal, and supplying the resultant total spectrum combined signal to the indivual having said given sensory spectrum, and (h) adjusting means for adjusting the ratio of the loudness of the multiplicity of modulated tone signals with respect to the loudness of said input signal, and for adjusting the loudness of the resultant total spectrum combined signal, both adjustments being made in relation to the specific sensory characteristics of the individual person having said given sensory spectrum.

10. Apparatus according to claim 9, with said modulating means comprising a multichannel modulator having respective channels with first and second inputs and having a set of tone generators for supplying respective ones of said multiplicity of alternating current waveforms of said different frequencies ($f_G$) to the respective first inputs of the respective channels, and having respective ones of said second inputs arranged for receiving ones of said output signals in said multiplicity of different frequency bands, and having respective channel outputs for supplying said multiplicity of modulated tone signals.

11. Apparatus according to claim 10, with said multichannel modulator having not more than twelve channels.

12. Apparatus according to claim 10, with said multichannel modulator having three channels.

13. Apparatus according to claim 10, with said multichannel modulator having six channels.

14. Apparatus according to claim 10, with said multichannel modulator having twelve channels.

15. Apparatus according to claim 10, characterized in that the tone generators of said set supply a multiplicity of alternating current waveforms of respective different frequencies ($f_G$) which are substantially uniformly distributed over a frequency range within said given sensory spectrum.

16. Apparatus according to claim 10, further characterized in that the tone generators supply a multiplicity of respective different frequencies ($f_G$) substantially corresponding to the mean frequencies ($f_m$) of the respective ones of said multiplicity of different frequency bands.

17. Apparatus according to claim 10, with the different frequency bands having band widths corresponding to about thirty percent of the associated mean frequency.

18. Apparatus according to claim 10, with the set of tone generators supplying respective frequencies ($f_G$) different from the respective mean frequencies ($f_m$) of the respective channels.

19. Apparatus according to claim 18, with the set of tone generators each supplying a frequency which lies in the range between the mean frequency of the associated channel and about one-half the mean frequency of the associated channel.

20. Apparatus according to claim 9, with said input means comprising a converter for converting speech signals into said input signal, said filter means comprising a set of band pass filters connected to the converter, said modulating means comprising rectifiers and smoothing low pass filters connected with outputs of respective ones of said band pass filters, said rectifiers and smoothing low pass filters having a response time which lies between forty milliseconds and eight milliseconds, said modulating means further comprising tone generators having outputs for supplying tone frequencies ($f_G$) which correspond to the mean frequencies ($f_m$) of the band pass filters; a signal transmitter which can be brought into electro-acoustical contact with the individual person who is hard of hearing, and said combining means comprising a summing circuit connected with said signal transmitter.

21. Apparatus according to claim 20, characterized in that the tone generators supply sinusoidal or rectangular or triangular waveforms.

22. Apparatus according to claim 20, characterized in that the signal transmitter for electro-acoustical contact with the person hard of hearing is a head set.

23. Apparatus according to claim 20, characterized in that the transmitter is a transmitter directly connected to the output of the summing circuit which can work in conjunction with the receiver of an implanted hearing aid equipped for stimulation of the auditory nerves.

24. Apparatus according to claim 14, with said filter means supplying output signals of the respective frequency bands with mean frequencies which lie at 225 Hz, 365 Hz, 515 Hz, 690 Hz, 915 Hz, 1.2 kHz, 1.6 kHz, 2.2 kHz, 2.9 kHz, 4.1 kHz, 5.8 kHz and 8.3 kHz and such that the band width of the individual frequency bands amounts to approximately thirty percent of the mean frequency and the channel separation measured at the mean frequency amounts to eleven through seventeen decibels; and with smoothing low pass filters present at the second inputs to said modulator, the response time of the smoothing low pass filters for the lower six channels being forty milliseconds and being eight milliseconds for the remaining channels.

25. Apparatus according to claim 24, with said set of tone generators including a lowest tone generator, a low pass filter for connection between said input means and said combining means, and switch means being operable in one switching condition for connecting the lowest tone generator with said combining means for supplying a lowest modulated tone signal to said combining means, and being operable in a second switching condition to connect the low pass filter between said input means and said combining means while disconnecting the lowest modulated tone signal from said combining means.

26. Apparatus according to claim 24, with said adjusting means comprising a first limiter amplifier for transmitting the modulated tone signals to the combining means and comprising a second limiter amplifier for transmitting the total spectrum of the input signal to said combining means.

27. Apparatus according to claim 26, with a control filter (39) between said input means and said combining means, said control filter having an attenuation characteristic which is set in such manner that optimum speech intelligibility ensues for the patient.

28. Apparatus according to claim 20, with said signal transmitter being a bone-conduction earpiece.

29. Apparatus according to claim 20, with said signal transmitter being a vibro-tactile stimulator (40).

30. Apparatus according to claim 20, with the signal transmitter being an electrocutaneous stimulator (41).

31. Apparatus according to claim 15, wherein the set of tone generators supply a multiplicity of alternating current waveforms of respective different frequencies substantially uniformly distributed over a frequency range from about 500 Hertz to near the upper limit of the given sensory spectrum.

32. Apparatus according to claim 15, wherein the set of tone generators supply a multiplicity of alternating current waveforms of respective different frequencies substantially uniformly distributed over a frequency range from about 100 Hertz to near the upper limit of the given sensory spectrum.

* * * * *